United States Patent [19]

Keith

[11] 4,011,640

[45] Mar. 15, 1977

[54] YARN ENTANGLEMENT NOZZLE

[75] Inventor: Jay Keith, Travelers Rest, S.C.

[73] Assignee: Milliken Research Corporation, Spartanburg, S.C.

[22] Filed: Oct. 20, 1975

[21] Appl. No.: 623,977

[52] U.S. Cl. ..... 28/1.4

[51] Int. Cl.[2] ..... D02G 1/16

[58] Field of Search ..... 28/1.4, 72.12; 57/34 B, 57/157 F; 226/7, 97; 302/25, 63; 239/600, 602

[56] References Cited

UNITED STATES PATENTS

| | | | |
|---|---|---|---|
| 3,220,082 | 11/1965 | Fletcher et al. | 28/1.4 |
| 3,325,872 | 6/1967 | Ethridge et al. | 28/1.4 |
| 3,333,313 | 8/1967 | Gilmore et al. | 28/1.4 |
| 3,353,344 | 11/1967 | Clendening | 28/1.4 X |
| 3,396,442 | 8/1968 | Gilmore | 28/1.4 |
| 3,535,755 | 10/1970 | Brown | 28/1.4 |
| 3,730,413 | 5/1973 | McDermott et al. | 28/1.4 |
| 3,822,449 | 7/1974 | Dick | 28/1.4 |

*Primary Examiner*—Louis K. Rimrodt
*Attorney, Agent, or Firm*—H. William Petry; Earle R. Marden

[57] ABSTRACT

An air jet nozzle to entangle the filaments of a continuous synthetic multifilament yarn or yarns by directing a jet of air substantially perpendicular to the running strand of yarn or yarns to be entangled. The yarn passes through an opening in the nozzle which has an upper curved surface to control the flow of air and to prevent dead air shots whereat the yarn will not be entangled.

3 Claims, 8 Drawing Figures

YARN ENTANGLEMENT NOZZLE

Prior to this invention multifilament yarns have been entangled by the application of an air jet thereto but certain problems have been encountered which caused the yarn to be difficult to handle. In particular it has been found that certain air nozzles caused the yarn to have only spaced areas of entanglement which tended to strip back in weaving causing lines or stripes in the woven fabric. Such a fabric then would be considered second quality and could not be sold at the best prevailing rate.

Therefore, it is an object of this invention to provide an air jet nozzle which will provide an improved entangled continuous synthetic multifilament yarn.

Other objects and advantages of the invention will become readily apparent as the specification proceeds to disclose the invention, in which.

Figure 1:
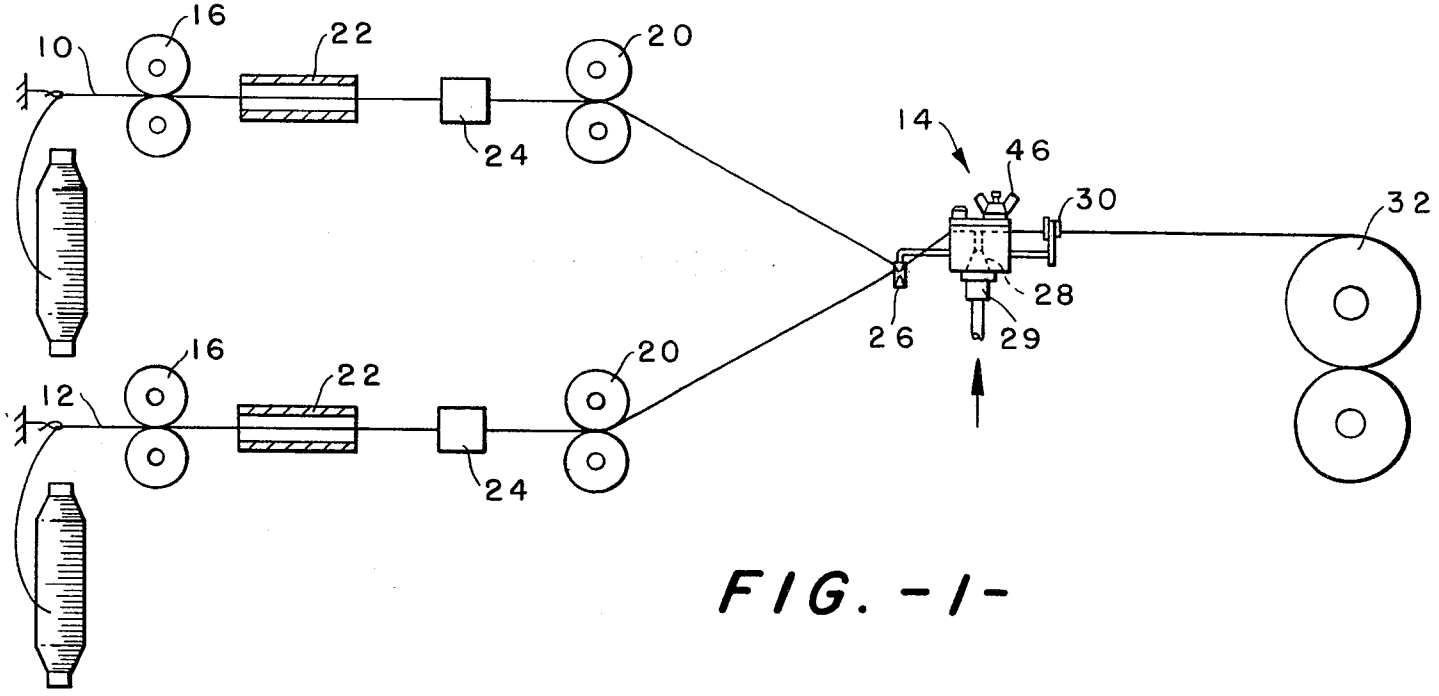
FIG. 1 shows a single continuous process for texturing two strands of multifilament yarn and entangling same in an improved air jet nozzle.
Figure 2:
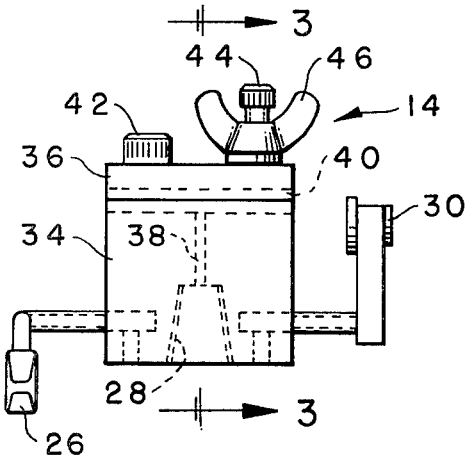
FIG. 2 is a blown up side view of the nozzle shown in FIG. 1.
Figure 3:
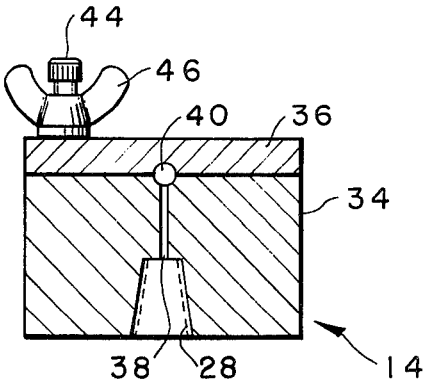
FIG. 3 is a cross-section view taken on line 3—3 of FIG. 2.
Figure 4:
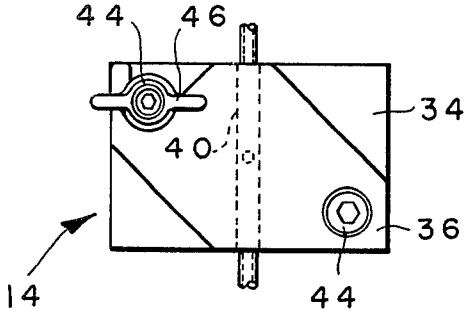
FIG. 4 is a top view of the nozzle shown in FIG. 2.
Figure 5:
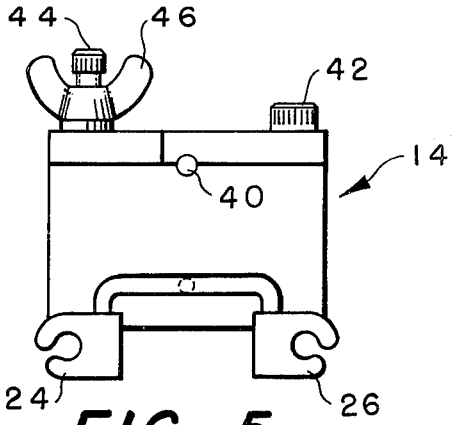
FIG. 5 is a left hand end view of FIG. 2.

Looking now to FIG. 1, the reference numerals 10 and 12 refer to two continuous synthetic multifilament yarns each of which are being supplied to the entangling air jet nozzle 14 through a conventional false twist zone by driven nip rolls 16 and 20. In conventional manner, the false twist zone employs a heating tube 22 and any conventional false twist device 24. The yarns 10 and 12 are each guided into the nozzle 14 by individual eyelets or yarn guides 24 and 26 wherein they are entangled by air under pressure from conduit 29 supplied into the air inlet 28. The entangled yarn is guided out of the air nozzle 14 by another yarn guide 30 and taken up on the take-up package 32.

The preferred form of yarn entangling air jet nozzle is shown in FIGS. 2 – 5 and basically consists of a body portion 34 and a cap portion 36. The body portion has an air orifice 38 substantially perpendicular to the yarn passage 40. The yarn passage 40 in the form of the invention is formed by matching semicircular slots in the body portion 34 and the bottom of the cap portion 36. The cap portion 36 is secured flush to the body portion 34 by bolts 42 and 44 with bolt 44 having a wing nut 46 thereon. In operation the wing nut 46 is loosened and the cap portion pivoted on the bolt 42 in a substantially parallel to the body portion 34 so the yarn can be placed in the slot in the lower body portion 34. Then the cap is repositioned and the wing nut tightened to secure the cap in position. As noted previously yarn guides 24 and 26 are secured to the inlet side of the nozzle and yarn guide 30 is secured to the outlet side.

In the preferred form of the invention the yarn passage 40 has a diameter of one-eighth of an inch while the air orifice has a diameter of one-sixteenth of an inch. Air is supplied to the orifice in the range of 20–40 psi, preferably 30 psi with a yarn output from the nozzle of 175 yards per minute. As an example each of the two yarns 10 and 12 are initially 250 denier multifilament partially drawn polyester and are drawn further in the false twist zone, entangled in the air nozzle and exit therefrom as a two ply 150 denier polyester yarn.

As briefly discussed before it is desired to accomplish as much entanglement of the yarn as possible so the upper portion of the yarn passage 40 is provided with a concave curved surface so that it will guide the air projected thereagainst in a downward and outward direction to cause intimate contact of the yarns in the passage by the air under pressure. This, of course, results in the individual filaments, becoming entangled to provide a single two ply yarn.

Figure 6:
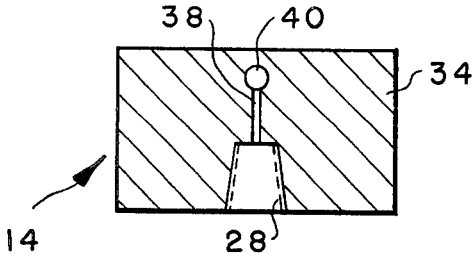
FIG. 6 is a view similar to FIG. 3 showing a modified nozzle.
Figure 7:
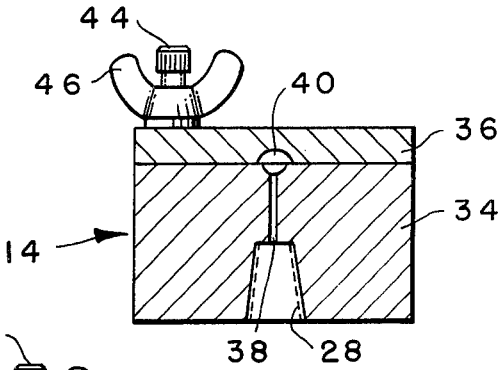
FIG. 7 is another view similar to FIG. 3 showing another modified nozzle; and, FIG. 8 is a cross-section view similar to FIG. 2 showing a further modification of the air jet nozzle.
Figure 8:
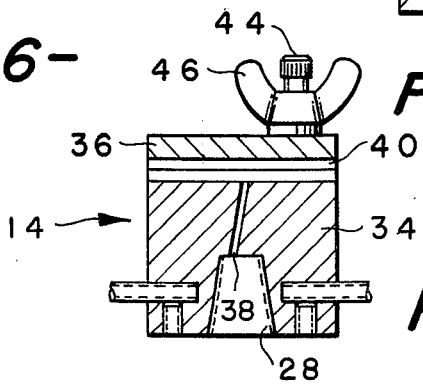

FIGS. 6 – 8 show various modifications of the entangling air nozzle shown in FIGS. 1 – 5 and like parts will be referred to with like reference numerals.

FIG. 6 is very similar to FIGS. 1 – 5 except the air nozzle 14 is a one piece construction with the circular passage 40 being drilled through the nozzle.

FIG. 7 also shows a construction similar to that of FIGS. 1 – 5 except that the concave slot in the cap portion 36 has a greater diameter than the slot in the body portion 34 to cause the air to exert an inward force on both sides of the yarn in the yarn passage to maintain it over the air orifice to obtain maximum entanglement due to the air jet pressure.

FIG. 8 shows a further modification which is applicable to all the previous embodiments in that the basic change involves inclining the air orifice 38 at an angle of approximately 12° from the vertical towards the air nozzle outlet. This has been found to enhance the entanglement of certain yarns and to aid in the passage of such yarns through the yarn passage.

It can readily be seen that an air jet entanglement nozzle has been disclosed which will readily entangle individual filaments of a single yarn as well as individual filaments of a multifilament of yarns to provide the equivalent of a plied yarn without the use of a plying operation.

Although the preferred embodiments of the invention have been described, it is contemplated that changes may be made without departing from the scope or spirit of the invention and it is, therefore, desired that the invention be limited only by the scope of the claims.

That which is claimed is:

1. A filament entangling air jet nozzle comprising: a body portion having a substantially planar surface, a cap portion having a substantially planar surface, means releasably securing said cap portion to said body portion with substantially all of the planar surface of said cap portion flush with the planar surface of said body portion and allowing said cap portion to be pivoted in a direction substantially parallel to the planar portion of said body portion when released, said body portion having a yarn slot therethrough, said cap portion having a yarn slot therethrough mating with the yarn slot of said body portion and an air orifice in said body portion communicating with said yarn slot in said body portion.

2. The nozzle of claim 1 wherein said yarn slots are arcuate shaped.

3. The nozzle of claim 1 wherein said yarn slots are substantially semicircular shaped.

* * * * *

UNITED STATES PATENT OFFICE

CERTIFICATE OF CORRECTION

Patent No. 4,011,640 Dated March 15, 1977

Inventor(s) Jay Keith

It is certified that error appears in the above-identified patent and that said Letters Patent are hereby corrected as shown below:

Column 1, line 58, after "a" insert --direction--.

Signed and Sealed this

Tenth Day of May 1977

[SEAL]

*Attest:*

RUTH C. MASON
*Attesting Officer*

C. MARSHALL DANN
*Commissioner of Patents and Trademarks*